US007166401B2

(12) United States Patent
Tanaka et al.

(10) Patent No.: US 7,166,401 B2
(45) Date of Patent: Jan. 23, 2007

(54) TONER FOR ELECTROPHOTOGRAPHY, IMAGE-FORMING METHOD, IMAGE-FORMING APPARATUS AND TONER CARTRIDGE

(75) Inventors: Hiroyuki Tanaka, Minamiashigara (JP); Shuji Sato, Minamiashigara (JP); Yosuke Tsurumi, Minamiashigara (JP); Manabu Serizawa, Minamiashigara (JP); Tsutomu Kubo, Minamiashigara (JP); Shigeru Seitoku, Minamiashigara (JP); Kazuhiko Yanagida, Minamiashigara (JP)

(73) Assignee: Fuji Xerox Co., Ltd., Tokyo (JP)

( * ) Notice: Subject to any disclaimer, the term of this patent is extended or adjusted under 35 U.S.C. 154(b) by 307 days.

(21) Appl. No.: 10/790,777

(22) Filed: Mar. 3, 2004

(65) Prior Publication Data

US 2005/0008963 A1 Jan. 13, 2005

(30) Foreign Application Priority Data

Jul. 11, 2003 (JP) ..... 2003-195739

(51) Int. Cl.
*G03G 9/08* (2006.01)

(52) U.S. Cl. ..... 430/108.1; 430/111.4; 430/124; 399/111

(58) Field of Classification Search ..... 430/111.4, 430/108.1, 124; 399/111
See application file for complete search history.

(56) References Cited

U.S. PATENT DOCUMENTS

| | | | | |
|---|---|---|---|---|
| 2,297,691 | A | 10/1942 | Carlson | |
| 5,597,386 | A * | 1/1997 | Igarashi et al. | 8/405 |
| 5,660,959 | A | 8/1997 | Moriyama et al. | |
| 5,753,399 | A * | 5/1998 | Hayase et al. | 430/111.4 |
| 5,827,632 | A * | 10/1998 | Inaba et al. | 430/108.6 |
| 5,968,701 | A * | 10/1999 | Onuma et al. | 430/111.4 |
| 6,033,819 | A | 3/2000 | Matsui et al. | |
| 6,664,016 | B1 * | 12/2003 | Kanbayashi et al. | 430/109.3 |
| 2002/0051924 | A1 * | 5/2002 | Iida et al. | 430/111.4 |
| 2003/0008225 | A1 * | 1/2003 | Emura et al. | 430/109.4 |

FOREIGN PATENT DOCUMENTS

| | | |
|---|---|---|
| JP | B 42-23910 | 11/1967 |
| JP | A 51-36947 | 3/1976 |
| JP | A 61-62045 | 3/1986 |
| JP | A 1-303447 | 12/1989 |
| JP | A 6-19182 | 1/1994 |
| JP | A 8-220800 | 8/1996 |
| JP | A 2001-305794 | 11/2001 |

OTHER PUBLICATIONS

Diamond, Arthur S & David Weiss (eds.) Handbook of Imaging Materials. New York: Marcel-Dekker, Inc. (Nov. 2001) pp. 145-164.*

* cited by examiner

*Primary Examiner*—Christopher Rodee
(74) *Attorney, Agent, or Firm*—Oliff & Berridge, PLC

(57) ABSTRACT

The present invention provides a toner for electrophotography comprising a binder resin, a coloring agent and a release agent, wherein the toner has a storage modulus G' of $5.0\times10^2$ to $1.0\times10^5$ Pa at 180° C. and an adhesive force to an aluminum substrate of not more than 50 N/m at 180° C. The invention also provides an image-forming method, which includes charging a surface of an image-bearing body; forming an electrostatic latent image according to image information on the charged surface of the image-bearing body; developing the electrostatic latent image formed on the surface of the image-bearing body with the toner to provide a toner image; transferring the toner image formed on the surface of the image-bearing body to a surface of a recording medium, and fusing the toner image transferred on the surface of the recording medium.

10 Claims, 1 Drawing Sheet

TONER FOR ELECTROPHOTOGRAPHY, IMAGE-FORMING METHOD, IMAGE-FORMING APPARATUS AND TONER CARTRIDGE

CROSS-REFERENCE TO RELATED APPLICATION

This application claims benefit of and priority to Japanese Patent Application No. 2003-195739, filed on Jul. 11, 2003, which is incorporated herein by reference in its entirety for all purposes.

BACKGROUND OF THE INVENTION

1. Field of the Invention

The present invention relates to a toner for electrophotography, used for developing an electrostatic latent image formed with a developing agent in an electrostatic photography process and the like, and to an image-forming method using the toner for electrophotography, an image-forming apparatus and a toner cartridge.

2. Description of the Related Art

Many electrophotographic methods are known, such as those disclosed in U.S. Pat. No. 2,297,691, Japanese Patent Application Publication (JP-B) No. 42-23910 and the like. Electrophotographic methods generally includes basic steps such as exposure, wherein an electrically latent image is formed onto a surface layer of photoreceptor that utilizes a photoconductive substance by various means; developing the image by using a toner; transferring the toner to a recording material such as paper; fusing the toner image on the recording material by heat, pressure, heat pressure or solvent vapor or the like; removing the residual toner from the surface layer of photoreceptor and the like. Recently, a demand has grown for low cost and small size copying machines and printers utilizing electrophotographic methods. In the process of designing such copying machines or printers, it is important to contain the amount of power required to fuse a toner, and also to simplify the method of fusing. The method most generally used at present is that of fusing using a heat roll as a means for melt-fusing a toner on a paper. In order to prevent melt-adhesion of a toner during heat-fusing of the toner, a heat roll has been used in which the roll surface layer is coated with a material having low surface energy, such as a fluorine resin, and materials to capable of being used for the roll surface have accordingly been limited. Furthermore, since, during heating of the fusing roll, heat conduction is sometimes impeded in the fluorine resin, for the purpose of obtaining effective heat conduction, the thickness of the fluorine resin on the surface layer of the fusing roll has been limited. Moreover, the resin can be abraded or damaged by repetitive use, and wettability on the surface of the fusing roll cannot be maintained over a long time period. Therefore, there has been a demand for the development of a toner that does not require any coating on the surface of a fusing roll, combined with a material having low surface energy such as a fluorine resin.

On the other hand, a pressure-fusing method using a metal roll is known (Japanese Patent Application Laid-Open (JP-A) No. 51-36947). However, this pressure-fusing method entails a problem, insofar that since the image is pressed by pressure the fusing property of the fusing image is weak, e.g., images have easily peeled off as a result of external forces as small as a pressure exerted by a ballpoint pen. Furthermore, in order to improve fusing property in the pressure-fusing method, attempts have been made to prepare a microcapsule toner having a microphase separation structure composed of continuous phases of resin and a solvent having high a boiling point (JP-A No. 6-19182). However, since a solvent component is used in this method, the method has entailed problems in therms of storage stability and the blocking property of the fused image.

Furthermore, two oil-less fusing methods that do not require any feeding of oil to a heat roll are known, one, a method of adding to a toner a release agent such as a wax (JP-A No. 61-62045), and the other, a method for defining the storage elasticity of a resin, by noting the adhesive force to a recording medium during melt-fusing of a toner and the aggregation force of the melt toner (JP-A No. 1-303447). Furthermore, a method for controlling the above-mentioned elasticity by internal addition of microparticles (JP-A No. 8-220800), a method for defining the elasticity in a toner in which microparticles have been internally added (JP-A No.2001-305794) and the like are known. However, in each of these methods, in order to obtain a releasing property a heat-fusing roll is required having the kind of low surface energy described above.

SUMMARY OF THE INVENTION

The present invention has a solution to the above-mentioned problems. Namely, the invention aims at providing a toner for electrophotography that ensures heat-fusing irrespective of what material is used for the heat-fusing roll and a toner which can also provide good image quality; an image-forming method using the toner for electrophotography, an image-forming apparatus and a toner cartridge.

The problems can be solved by the following invention described below. Namely, the invention provides a toner for electrophotography comprising a binder resin, a coloring agent and a release agent, wherein the toner has a storage modulus G' of $5.0\times10^2$ to $1.0\times10^5$ Pa at 180° C. and an adhesive force to an aluminum substrate of not more than 50 N/m at 180° C.

Further, the invention provides an image-forming method, comprising:

charging a surface of an image-bearing body;

forming an electrostatic latent image according to image information on the charged surface of the image-bearing body;

developing with the toner the electrostatic latent image formed on the surface of the image-bearing body, in order to obtain a toner image;

transferring to a surface of a recording medium the toner image formed on the surface of the image-bearing body, and fusing the toner image transferred on the surface of the recording medium.

Furthermore, the invention provides an image-forming apparatus comprising:

means for charging a surface of an image-bearing body;

means for forming on the charged surface of the image-bearing body an electrostatic latent image corresponding to image information;

means for developing with the toner the electrostatic latent image formed on the surface of the image-bearing body, in order to provide a toner image;

means for transferring the toner image formed on the surface of the image-bearing body to a surface of a recording medium, and means for fusing the toner image transferred on the surface of the recording medium.

DETAILED DESCRIPTION OF THE INVENTION

Figure 1:
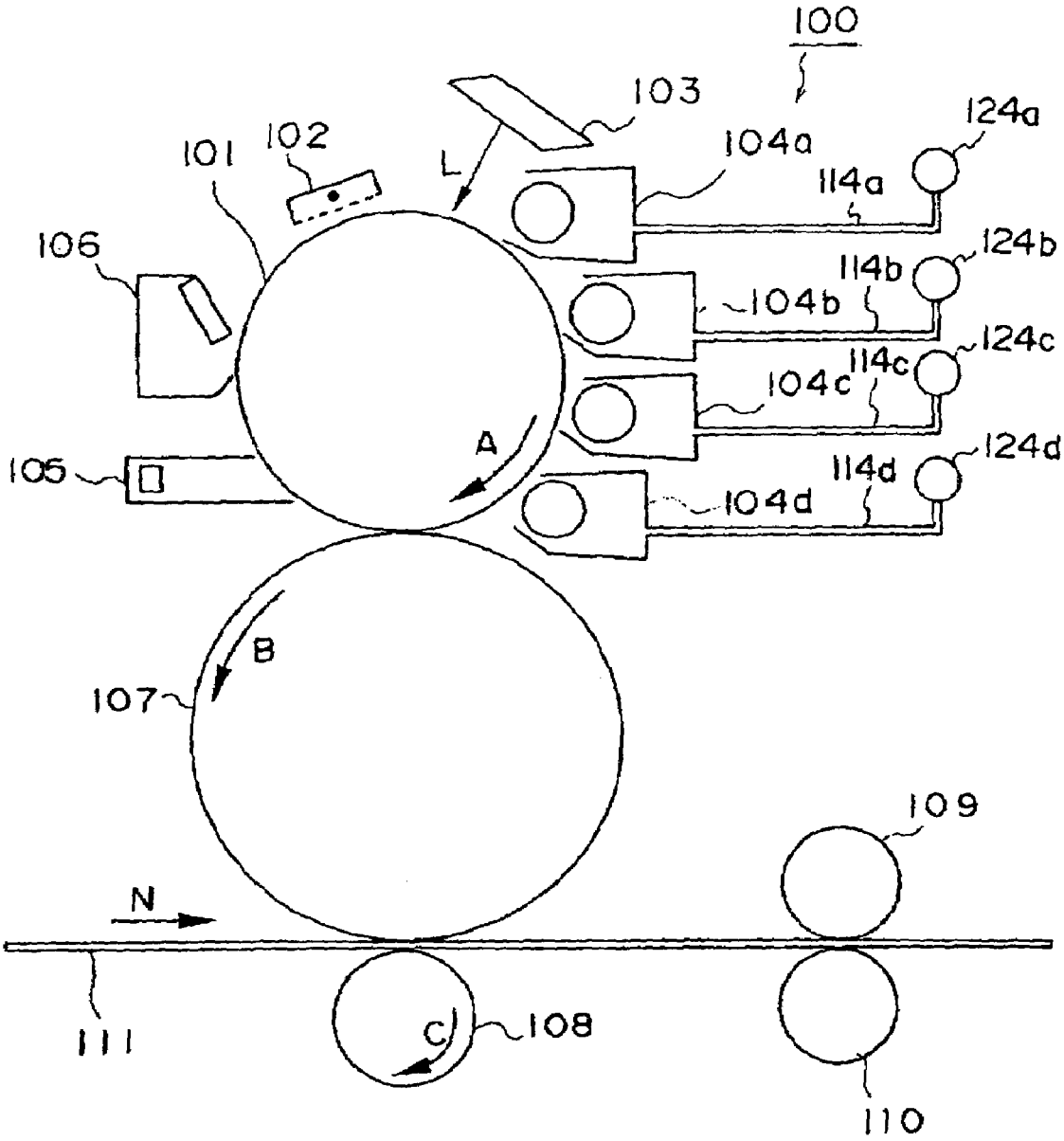
FIG. 1 is a schematic illustration of the image-forming apparatus of the present invention.

Hereinafter the present invention is explained in detail.

Toner for Electrophotography

The characteristic of the toner for electrophotography of the invention (hereinafter sometimes to be abbreviated as "toner") is exemplified in order. The binder resin used for the invention is not particularly limited, and any known resin material may be used. Examples include homopolymers or copolymers of two or more of styrenes; vinyl group-containing esters such as methyl acrylate, ethyl acrylate, butyl acrylate, propyl acrylate, lauryl acrylate, ethyl hexyl acrylate, methyl methacrylate, ethyl methacrylate, butyl methacrylate, propyl methacrylate, lauryl methacrylate, ethyl hexyl methacrylate, vinyl acetate, vinyl benzoate; double bond containing-carboxylic acids such as methyl maleate, ethyl maleate, butyl maleate; olefins such as ethylene, propylene, butylene, butadiene; carboxylic acids such as acrylic acid, methacrylic acid, maleic acid, and mixtures thereof. Furthermore, examples include epoxy resins, polyester resins, polyurethane resins, polyamide resins and cellulose resins. Of these, homopolymer of styrene or copolymers of styrene with acrylic acid esters or methacrylic acid esters and polyester resins are preferred.

As the coloring agent for the invention, known organic or inorganic pigments, dyes or oil soluble dyes can be used. Examples may include C.I. Pigment Red 48:1, C.I. Pigment Red 57:1, C.I. Pigment Red 122, C.I. Pigment Yellow 17, C.I. Pigment Yellow 97, C.I. Pigment Yellow 12, C.I. Pigment Yellow 180, C.I. Pigment Yellow 185, C.I. Pigment Blue 15:1, C.I. Pigment Blue 15:3, lamp black (C.I. No. 77266), rose bengal (C.I. No. 45432), carbon black, nigrosine dye (C.I. No. 50415B), metal complex salt dyes, derivatives of metal complex salt dyes, and mixtures thereof. Furthermore, examples include silica, aluminum oxide, magnetite, various ferrites, various metal oxides such as copper (II) oxide, nickel oxide, zinc oxide, zirconium oxide, titanium oxide, magnesium oxide, and suitable mixtures thereof. Suitable ratio for the coloring agent is generally about 1 to 100 parts by mass relative to 100 parts by mass of toner, depending on the particle size of the toner or the amount to be developed. Specifically, 2 to 30 parts by mass is preferred.

The coloring agent is dispersed by a known method such as by a rotation shear type homogenizer, a media type ball mill, a sand mill and the like.

Specific examples of the release agent for the invention include waxes such as vegetable waxes such as carnauba wax, cotton wax, wood wax, rice wax, animal waxes such as honey wax, lanolin, mineral waxes such as ozokelite, selsyn, and petrolatum waxes such as paraffin, microcrystalline, petrolatum. Besides these natural waxes, synthetic hydrocarbon waxes such as Fischer-Tropsh wax, polyethylene wax, synthetic waxes such as aliphatic acid amides such as 12-hydroxystearic acid amide, stearic acid amide, phthalic anhydride imide, chlorinated hydrocarbons, esters, ketones, ethers may be used. Other examples of the release agent include crystalline polymer having long alkyl groups as a side chain such as homopolymers or copolymers of polyacrylates such as poly-n-stearyl methacrylate, poly-n-lauryl methacrylate (e.g., copolymer of n-stearyl acrylate/ethyl methacrylate). More preferred examples of these include petrolatum waxes or synthetic waxes such as paraffin wax, microcrystalline wax.

The content of release agent for the invention is preferably 5 to 40% by mass, more preferably 10 to 30% by mass, and particularly preferably 15 to 25% by mass. Since the content of the release agent is not less than 5% by mass, sufficient releasing property can be ensured and hot offset can be prevented. On the other hand, if the content of the release agent is not more than 40% by mass, the release agent does not appear on the toner surface, and can provide fluidity and electrostatic property.

Furthermore, in the invention, a release agent having a melting point of 50 to 150° C. is preferably used among the release agents exemplified above, and the melting point is preferably 60 to 120° C., particularly preferably 70 to 100° C. Since the melting point is not less than 50° C., the toner exhibits superior storage stability, and if the melting point is not more than 150° C., hot offset during fusing can be prevented.

The adhesive force of the toner of the invention to an aluminum substrate can be measured using a universal tensile tester (manufactured by Toyo Seiki Seisaku-sho, Ltd.). Firstly, a toner is uniformly transferred on normal paper, which is a recording media, at the length of 10 mm and width of 35 mm and at the amount to be transferred of 4.5 g/m$^2$. The toner is fused using a heat-fusing roll at the temperature of 180° C., and paper on which the toner has been fused is superposed onto the aluminum substrate. The temperature is adjusted to 180° C. in a thermostatic chamber, and the adhesive force of the fused image to the aluminum substrate is calculated using a universal tensile tester. As used herein, the paper may be any paper generally used in an image-forming apparatus, and examples thereof include L-paper, P-paper and S-paper (all are manufactured by Fuji Xerox Co., Ltd.). The aluminum substrate as used herein has a mirror surface. The adhesive force preferably comes near 0 N/m as possible, and practically required to be not more than 50 N/m, preferably not more than 30 N/m, and more preferably not more than 15 N/m. When the adhesive force is greater than 50 N/m, the releasing property between the fusing apparatus such as a fusing roll and a recording media deteriorates markedly, which leads to a problem in that good image quality cannot be obtained.

The storage modulus G' for the toner of the invention is required to be $5\times10^2$ to $1\times10^5$ Pa at 180° C., preferably $5\times10^2$ to $5\times10^4$ Pa, and particularly preferably $1\times10^3$ to $1\times10^4$ Pa. When the storage modulus G' is lower than $5\times10^2$ Pa, which leads to a problem in that the melt toner adheres during fusing and causes offset. On the other hand, when the storage modulus G' greater than $1\times10^5$ Pa, the fusing property is markedly deteriorated. For the measuring method of elasticity, ARES measuring apparatus (trade name, manufactured by Rheometric Scientific, Inc.) is used. A toner is formed into a tablet and set in a parallel plate having a diameter of 25 mm, and storage modulus G' at 180° C. is calculated at the angular velocity of $\omega=10$ rad/sec.

The relationship between a release agent content W and the storage modulus G' of the toner of the invention is preferably satisfies $G' \geqq 0.875\times10^4\ (100-W)/W(\times10^3\ \text{Pa})$. When the relation between the release agent content W and the storage modulus G' satisfy the above relationship, the peeling property during fusing is ensured, which prevents hot offset.

For the toner of the invention, if necessary, inorganic or organic microparticles are preferably incorporated in the toner so as to control the storage elasticity. Examples of the inorganic microparticles include metals and oxides thereof, nitrides, carbonates, nitrates, sulfates, particularly silica, alumina, titanium compound, calcium carbonate. Examples of the organic microparticles include vinyl resin, polyester, silicone.

The amount of the microparticles to be included in the toner is preferably 1 to 30% by mass, more preferably 1 to 20% by mass, and particularly preferably 1 to 10% by mass. Since the microparticles are included in an amount of not less than 1% by mass, the storage elasticity can be easily controlled, and if microparticles are included in an amount of not more than 30% by mass, the microparticles do not appear onto the surface of toner and can provide fluidity and electrostatic property.

Regarding the above microparticles, in the preferred case, the inorganic microparticles are incorporated in an amount of 1 to 20% by mass, particularly preferably in an amount of 1 to 10% by mass. The use of the inorganic microparticles has advantages that the elasticity can be controlled more easily and that the dispersion property in the toner particle is better, as compared to the use of organic microparticles. If the toner comprises the inorganic microparticles by the amount is not less than 1% by mass, the storage elasticity can be easily controlled, and if the amount is not more than 20% by mass, the toner particles can be easily produced and the dispersion can be controlled.

In addition, the particle size of the organic or inorganic microparticles is preferably 5 to 200 nm, more preferably 10 to 100 nm, and particularly preferably 10 to 20 nm. If the particle size is not less than 5 nm, the toner has advantages that the particles can be easily dispersed in the toner and that aggregation between the microparticles is difficult to occur, and if the particle size is not more than 200 nm, the invention has advantages that the dispersion in the toner can be easily controlled and the appearance of the particles onto the surface is decreased.

The volume average particle size measured by D50 Coulter counter for the toner of the invention is preferably 4.0 to 10.0 μm, more preferably 5.0 to 8.0 μm, particularly preferably 5.0 to 7.0 μm. If the size is not less than 4.0 μm, the occurrence of cloud due to soaring of the toner can be prevented, and if the size is not more than 10.0 μm, a high-grade image can be obtained.

Furthermore, the preferable particle size distribution of the toner of the invention has $(D84v/D16v)^{1/2}$ (GSDv: volume average particle size distribution index), which is a ratio of the accumulative 84% diameter (D84v) of the volume particle size and the accumulative 16% diameter (D16v) measured by Coulter counter, of not more than 1.30, and $(D84p/D16p)^{1/2}$ (GSDp: number average particle size distribution index) of the number particle size is not more than 1.40. If the GSDv is not more than 1.30 and GSDp is not more than 1.40, a high-grade image can be obtained.

In addition, inorganic particles or organic particles sheared in dry state, as a fluidity aid or a cleaning aid, can be added to the surface of the toner of the invention. Examples of such inorganic particles include every particles those generally used as an external additive of a toner surface such as silica, alumina, titania, calcium carbonate, magnesium carbonate, calcium triphosphate, cerium oxide, and examples of the organic particles include every particles those generally used as an external additive of a toner surface such as vinyl resins, polyester resins, silicone resins. These inorganic particles or organic particles can be used as a fluidity aid, a cleaning aid and the like. Furthermore, if necessary, a lubricating agent or a charge-controlling agent may be added to the toner. Examples of the lubricating agent that can be used include aliphatic acid amides such as ethylene bisstearic acid amide, oleic acid amide, aliphatic acid metal salts such as zinc stearate, calcium stearate. Examples of the charge-controlling agent that can be suitably used include compounds used in a powder toner selected from the group consisting of metal salts of benzoic acid, metal salts of salicylic acid, metal salts of alkylsalicylic acid, metal salts of catechol, metal-containing bisazo dye, tetraphenylborate derivatives, quaternary ammonium salts and alkylpyridinium salts, and suitable combinations thereof. The amount to be added of these external additives relative to the toner is generally 0% by mass to 10% by mass, more preferably 0.5 to 8% by mass.

Examples of the method for preparing the toner of the invention include kneading-pulverizing process, suspension polymerization method, aggregating coalescent method and solubility suspension method. Of these, suspension polymerization method, aggregating coalescent method and solubility suspension method are preferred since these method use components such as a wax and the like and can control the particle size distribution of the toner.

The aggregating coalescent method is briefly explained herein.

The aggregating coalescent method is a method at least comprising: the first aggregation step, which comprises forming core aggregated particles in a mixed liquid by adding an aggregating agent to the mixed liquid, wherein the mixed liquid is a mixture of the first resin microparticles dispersion liquid, in which the first resin microparticles having the average particle size of not more than 1 μm have been dispersed, a coloring agent dispersion liquid and a release agent dispersion liquid; the second aggregation step, which comprises forming core/shell aggregated particles by using the second resin microparticle dispersion liquid in which the second resin microparticles have been dispersed to form a surface layer comprising second resin microparticles on the surface of the core aggregated particles; and a fusing step, which comprises heating the core/shell aggregated particles to the temperature higher than the glass transition temperatures of the first resin microparticles and the second resin microparticles to fuse particles.

Examples of the resin microparticles dispersion liquid may include such as resin microparticle dispersion liquids in which resin particles have been dispersed by an ionic surfactant. Examples of the coloring agent dispersion liquid and release agent dispersion liquid include dispersion liquids dispersed by a surfactant having the opposite polarity to the ionic surfactant comprised in the resin microparticles dispersion liquid.

After the fusing step, a toner can be obtained by washing and drying according to a conventional method. Image-forming method and image-forming apparatus Secondly, the image-forming method and the image-forming apparatus using the toner of the invention are explained.

The image-forming method of the invention comprises: charging a surface of an image-bearing body; forming an electrostatic latent image according to image information on the charged surface of the image-bearing body; developing with a toner the electrostatic latent image formed on the surface of the image-bearing body, in order to obtain a toner image; transferring to a surface of a recording medium the toner image formed on the surface of the image-bearing body, and fusing the toner image transferred on the surface of the recording medium, wherein the toner is the toner of the invention as described above.

Accordingly, since the image-forming method of the invention uses the toner of the invention, which is extremely superior in the peeling property during fusing, the method provides superior releasing property of the toner image from the member contacting with the image during fusing, and can prevent problems such as hot offset, deterioration of image quality of the image obtained by fusing.

Furthermore, since the image-forming method of the invention uses the toner of the invention, which is extremely superior in the peeling property during fusing, a conventional fusing roll coated with a film having low surface energy, such as a fluorine resin film, is not required to use in the image-forming method using a heat-fusing roll. In the invention, the surface of a fusing roll may be, for example, a roll on which stainless steel (SUS) material or aluminum (AL) material, a material for a metal core of a fusing roll, is exposed as it is.

Although a surface material of the fusing roll in the image-forming method of the invention is not particularly limited, the surface energy of the material on the surface of the heat-fusing roll is preferably in the range of $0.1\times10^{-4}$ to $5.0\times10^{-4}$ J/cm$^2$, more preferably $0.5\times10^{-4}$ to $3.0\times10^{-4}$ J/cm$^2$, and particularly preferably $1.0\times10^{-4}$ to $3.0\times10^{-4}$ J/cm$^2$. Since the surface energy is not less than $0.1\times10^{-4}$ J/cm$^2$, the surface material is superior in durability and heat conduction property, and since the surface energy is not more than $5.0\times10^{-4}$ J/cm$^2$, the releasing property of the toner can be sufficiently retained. Specific examples of the material include metals such as Fe, Cr, Cu, Ni, Co, Mn, Al, and oxides of the metals or mixtures of the oxides. By using such materials on the surface of a fusing roll, the durability such as strength and abrasion resistance of the role are improved, and the role has good heat conduction property. Therefore, the heat efficiency of the roll is improved.

Secondly, the image-forming method of the invention using the above-mentioned image-forming apparatus of the invention is particularly explained. However, the invention is not limited to the specific examples explained below.

FIG. 1 is a schematic view of the image-forming apparatus of the invention. In FIG. 1, the image-forming apparatus 100 includes an image-bearing body 101, a charging device 102, a writing device for forming an electrostatic latent image 103, developing devices 104*a*, 104*b*, 104*c*, 104*d* each contains a developer for each of the colors black (K), yellow (Y), magenta (M) and cyan (C), an antistatic lamp 105, a cleaning device 106, an intermediate transfer body 107 and a transfer roll 108. In the developers contained in each of the developing devices 104*a*, 104*b*, 104*c* and 104*d*, the toner of the invention is contained.

Around the image-bearing body 101 are provided a non-contact type charging device 102 that uniformly charges the surface of the image-bearing body 101; a writing device 103, which irradiates the scanning exposure according to the image information, represented by the arrow L, to the surface of the image-bearing body 101 to form an electrostatic latent image on the surface of the image-bearing body 101; developing devices 104*a*, 104*b*, 104*c* and 104*d*, each of which provides a toner having each color to the electrostatic latent image; a drum-shaped intermediate transfer body 107, which abuts against the surface of the image-bearing body 101 and can rotate in the direction of the arrow B along with the rotation of the image-bearing body 101 in the direction of the arrow A; an antistatic lamp 105, which removes static charge on the surface of the image-bearing body 101, and a cleaning device 106, which abuts against the surface of the image-bearing body 101, in order along the rotational direction (direction of arrow A) of the image-bearing body 101.

Furthermore, a transfer roll 108, which can be controlled to abut or not abut against the surface of the intermediate transfer body 107, is provided on the side of the image-bearing body 101 opposite to the intermediate transfer body 107. When the transfer roll 108 abuts, it can be rotated to the direction of the arrow C along with the rotation of the intermediate transfer body 107 in the direction of the arrow B.

Recording media 111 can pass through the spacing between the intermediate transfer body 107 and the transfer roll 108 can be passed to the direction of the arrow N by conveying mean (not shown) that comes from the direction opposite to the arrow N. At the side of the direction of the arrow N of the intermediate transfer body 107 is provided a fusing roll 109 containing a heat source (not shown), at the side of the direction of the arrow N of the transfer roll 108 is provided a pressurizing roll 110. The fusing roll 109 abuts against the pressurizing roll 110 to form a nip portion. Furthermore, the recording media 111 that has passed between the intermediate transfer body 107 and transfer roll 108 can pass through in the nip portion toward the direction of the arrow N.

Furthermore, since the image-forming apparatus of the invention uses the toner of the invention, which is extremely superior in the peeling property during fusing, a conventional fusing roll coated with a film having low surface energy such as a fluorine resin film is not required in the image-forming method using a heat-fusing roll. In the invention, the surface of a fusing roll 109 may be, for example, a roll on which SUS material or AI material, which is a material for a metal core of a fusing roll 109, is exposed as it is.

The image-forming using the image-forming apparatus 100 is explained. Firstly, the surface of the image-bearing body 101 is uniformly charged by the non-contact type charging device 102 according to the rotation of the arrow A of the image-bearing body 101, an electrostatic latent image corresponding to the image information of the colors is formed on the surface of the uniformly charged image-bearing body 101 by the writing device 103, and the toners of the invention are provided from developing devices 104*a*, 104*b*, 104*c* and 104*d* according to the color information of the electrostatic latent image to the surface of the image-bearing body 101 on which the electrostatic latent image has been formed to provide a toner image.

The toner image formed on the surface of the image-bearing body 101 is transferred to the surface of the intermediate transfer body 107 at the contacting portion of the image-bearing body 101 and the intermediate transfer body 107, by applying a voltage between the image-bearing body 101 and the intermediate transfer body 107 by an electric source (not shown).

The static charge on the surface of the image-bearing body 101 on which the toner image has been transferred to the intermediate transfer body 107 is removed by irradiating light using the antistatic lamp 108, and the toner remaining on the surface is removed by cleaning blades of the cleaning device 106.

The above-mentioned step is repeated for each of the colors to superpose the toner images of the colors on the surface of the intermediate transfer body 107 so as to the images correspond to the image information.

In the above-mentioned step, the transfer roll 108 is not abutted against the intermediate transfer body 107, and is abutted against the intermediate transfer body 107 when the superposed toner images of all colors on the intermediate transfer body 107 is transferred to the recording media 111.

The thus-formed superposed toner images on the surface of the intermediate transfer body 107 are moved to the contacting portion of the intermediate transfer body 107 and the transfer roll 108 along with the rotation of the intermediate transfer body 107 in the direction of the arrow B. During this step, the recording media 111 is passed through the contacting portion by a paper-conveying roll (not shown) in the direction of the arrow N, and the toner images formed on the intermediate transfer body 107 are all transferred to the surface of the recording media 111 at the contacting portion by the voltage applied between the intermediate transfer body 107 and the transfer roll 108.

As such, the recording media 111 on which the toner images have been transferred is conveyed to the nip portion between the fusing roll 109 and the pressurizing roll 110, and the surface is heated by the fusing roll 109 in which the surface is heated by a heat source (not shown) when the surface passes the nip portion. During this step, the toner images are fused to the surface of the recording media 111 to form an image.

Toner Cartridge

Secondly, the toner cartridge of the invention is explained. The toner cartridge of the invention is detachable from an image-forming apparatus that comprises means for developing, the cartridge contains at least a toner provided to the means for developing, wherein the toner is the toner of the invention.

For the image-forming apparatus having the detachable toner cartridge, by using the toner cartridge containing the toner of the invention, an image can be formed using the toner of the invention, which is extremely superior in the peeling property during fusing. Therefore, the peeling property of the toner image from the member contacting to the toner image during fusing is superior, and problems such as hot offset, deterioration of image quality of the image obtained after fusing can be prevented.

Furthermore, in the image-forming apparatus having the detachable toner cartridge, by using the toner cartridge containing the toner of the invention, an image can be formed using the toner of the invention, which is extremely superior in the peeling property during fusing. Therefore, a conventional fusing roll coated with a film having low surface energy such as fluorine resin film is not required in the image-forming method using a heat-fusing roll. In the invention, the surface of a fusing roll may be, for example, a roll on which SUS material or AI material, a material for a metal core of a fusing roll, is exposed as it is.

The image-forming apparatus shown in FIG. 1 is preferably a image-forming apparatus comprising detachable toner cartridges 124*a*, 124*b*, 124*c* and 124*d*, which are toner cartridges for the colors yellow (Y), magenta (M), cyan (C) and black (K). The developing devices 104*a*, 104*b*, 104*c* and 104*d* are connected to the toner cartridges corresponding to the developing devices (and to the colors) by toner feeding tubes 114*a*, 114*b*, 114*c* and 114*d*.

In this case, since toners are provided to the developing device 104*a*, 104*b*, 104*c* and 104*d* from the toner cartridges 124*a*, 124*b*, 124*c* and 124*d* corresponding to the developing devices (colors) through toner feeding tubes 114*a*, 114*b*, 114*c* and 114*d* during the formation of the image, an image can be formed using the toner of the invention for a long tome period. Furthermore, when the toner contained in the toner cartridge is decreased, the toner cartridge can be replaced.

EXAMPLES

Hereinafter the present invention is explained by referring Examples and Comparative Example. However, the invention is not limited to the following Examples and Comparative Examples.

Firstly, Examples 1 to 6 and Comparative Examples 1 to 3 are explained as examples using toners comprising no organic or inorganic microparticles as a component.

Before preparing toners used in Examples 1 to 6 and Comparative Examples 1 to 3, the following samples are prepared.

Preparation of Resin Particle Dispersion Liquid A

| | |
|---|---|
| Styrene (manufactured by Wako Pure Chemical Industries, Ltd.) | 306 parts by mass |
| n-Butyl acrylate (manufactured by Wako Pure Chemical Industries, Ltd.) | 94 parts by mass |
| β-Carboxyethylacrylate (manufactured by Rhodia Nicca, Ltd.) | 12 parts by mass |
| 1,10-decanedioldiacrylate (manufactured by Shin-Nakamura Chemical Co., Ltd.) | 6.3 parts by mass |
| Dodecanethiol (manufactured by Wako Pure Chemical Industries, Ltd.) | 21.4 parts by mass |

The above components are mixed to dissolve. To the mixture is added a solution of an anionic surfactant (trademark: DOWFAX, manufactured by The Dow Chemical Company, 4 parts by mass) in ion exchanged water (570 parts by mass), and the mixture is dispersed in a flask, emulsified and gently stirred for 10 min. To the mixture is added ion exchanged water (50 parts by mass) in which ammonium persulfate (6 parts by mass) has been dissolved. The air in the flask is then sufficiently purged with nitrogen, and the solution in the flask is heated to 70° C. in an oil bath while the solution is stirred. The emulsion polymerization is then continued for 5 hrs to give an anionic resin particle dispersion liquid A. The central particle size of the resin microparticles in the resin particle dispersion liquid A is 235 nm, the amount of solid content is 42.9%, and the weight average molecular weight Mw is 35500.

Preparation of Resin Particle Dispersion Liquid B

| | |
|---|---|
| Styrene (manufactured by Wako Pure Chemical Industries, Ltd.) | 280 parts by mass |
| n-Butylacrylate (manufactured by Wako Pure Chemical Industries, Ltd.) | 120 parts by mass |
| β-Carboxyethylacrylate (manufactured by Rhodia Nicca, Ltd.) | 12 parts by mass |

The above components are mixed to dissolve. To the mixture is added a solution of an anionic surfactant (trademark: DOWFAX, manufactured by The Dow Chemical Company, 1.5 parts by mass) in ion exchanged water (550 parts by mass), and the mixture is dispersed in a flask, emulsified and gently stirred for 10 min. To the mixture is added ion exchanged water (50 parts by mass) in which ammonium persulfate (1 part by mass) has been dissolved. The air in the flask is then sufficiently purged with nitrogen, and the solution in the flask is heated to 70° C. in an oil bath while the solution is stirred. The emulsion polymerization is then continued for 5 hrs to give an anionic resin particle dispersion liquid B. The central particle size of the resin microparticles in the resin particle dispersion liquid B is 180 nm, the amount of solid content is 42.3%, the weight average molecular weight Mw is 797000, the number average molecular weight Mn is 266600, and the glass transition temperature is 53.5° C.

Preparation of Resin Particle Dispersion Liquid C

| | |
|---|---|
| Styrene (manufactured by Wako Pure Chemical Industries, Ltd.) | 280 parts by mass |
| n-Butylacrylate (manufactured by Wako Pure Chemical Industries, Ltd.) | 120 parts by mass |
| β-Carboxyethylacrylate (manufactured by Rhodia Nicca, Ltd.) | 12 parts by mass |

The above components are mixed to dissolve. To the mixture is added a solution of an anionic surfactant (trademark: DOWFAX, manufactured by The Dow Chemical Company, 1.5 parts by mass) in ion exchanged water (550 parts by mass), and the mixture is dispersed in a flask, emulsified and gently stirred for 10 min. To the mixture is added ion exchanged water (50 parts by mass) in which ammonium persulfate (1.5 parts by mass) has been dissolved. The air in the flask is then sufficiently purged with nitrogen, and the solution in the flask is heated to 70° C. in an oil bath while the solution is stirred. The emulsion polymerization is then continued for 5 hrs to give an anionic resin particle dispersion liquid C. The central particle size of the resin microparticles in the resin particle dispersion liquid C is 156 nm, the amount of solid content is 42.7%, the weight average molecular weight Mw is 664100, the number average molecular weight Mn is 202300, and the glass transition temperature is 52.9° C.

Preparation of Coloring Agent Particle Dispersion Liquid A

| | |
|---|---|
| Carbon black (trade name: R660R, manufactured by Cabot Corporation) | 30 parts by mass |
| Anion surfactant (trade name: Newrex R, manufactured by Nippon Oil & Fats Co., Ltd.) | 2 parts by mass |
| Ion exchanged water | 220 parts by mass |

The above components are mixed, and the mixture is pre-dispersed by a homogenizer (Ultra Turrax®, manufactured by IKA Japan K.K.) for 10 min. Dispersion is carried out using Ultimizer (cross-collision type wet-type pulverizer: manufactured by Sugino Machine Limited) at the pressure of 245 mPa for 15 min to give a coloring agent particle dispersion liquid A having a central diameter of 333 nm.

Preparation of Coloring Agent Particle Dispersion Liquid B

| | |
|---|---|
| Copper phthalocyanine (trade name: B15:3, manufactured by Dainichiseika Color & Chemicals Mfg. Co, Ltd.) | 45 parts by mass |
| Cationic surfactant (trade name: Neogen RK, manufactured by Dai-ichi Kogyo Seiyaku Co., Ltd.) | 5 parts by mass |
| Ion exchanged water | 200 parts by mass |

The above components are mixed, and the mixture is pre-dispersed by a homogenizer (Ultra-Turrax®, manufactured by IKA Japan K.K.) for 10 min. Dispersion is carried out using Ultimizer (cross-collision type wet-type pulverizer: manufactured by Sugino Machine Limited) at the pressure of 245 mPa for 15 min to give a coloring agent particle dispersion liquid B having a central diameter of 382 nm.

Preparation of Coloring Agent Particle Dispersion Liquid C

| | |
|---|---|
| Magenta pigment (trade name: R122, manufactured by Dainichiseika Color & Chemicals Mfg. Co, Ltd.) | 45 parts by mass |
| Nonionic surfactant (manufactured by Sanyo Chemical Industries, Ltd. NONIPOL 400) | 5 parts by mass |
| Ion exchanged water | 200 parts by mass |

The above components are mixed, and the mixture is pre-dispersed by a homogenizer (Ultra-Turrax®, manufactured by IKA Japan K.K.) for 10 min. Dispersion is carried out using Ultimizer (cross-collision type wet-type pulverizer: manufactured by Sugino Machine Limited) at the pressure of 245 mPa for 15 min to give a coloring agent particle dispersion liquid C having a central diameter of 246 nm.

Preparation of Coloring Agent Particle Dispersion Liquid D

| | |
|---|---|
| Yellow pigment (trade name: PY74, manufactured by Clariant (Japan) K.K.) | 45 parts by mass |
| Nonionic surfactant (trade name: Nonipol 400, manufactured by Sanyo Chemical Industries, Ltd.) | 5 parts by mass |
| Ion exchanged water | 200 parts by mass |

The above components are mixed, and the mixture is pre-dispersed by a homogenizer (Ultra-Turrax®, manufactured by IKA Japan K.K.) for 10 min. Dispersion is carried out using Ultimizer (cross-collision type wet-type pulverizer: manufactured by Sugino Machine Limited) at the pressure of 245 mPa for 15 min to give a coloring agent particle dispersion liquid D having a central diameter of 215 nm.

Preparation of Release Agent Particle Dispersion Liquid A

| | |
|---|---|
| Polyethylene wax (trade name: PW725, manufactured by Toyo-Petrolite, melting point 104° C.) | 45 parts by mass |
| Cationic surfactant (trade name: Neogen RK, manufactured by Dai-ichi Kogyo Seiyaku Co., Ltd.) | 5 parts by mass |
| Ion exchanged water | 200 parts by mass |

The above components are mixed and heated to 950° C., and the mixture is pre-dispersed by a homogenizer (Ultra-Turrax®, manufactured by IKA Japan K.K.) for 10 min. Dispersion is carried out using Gaulin homogenizer (pressure-ejective type pulverizer, manufactured by Gaulin Inc.) to give a release agent particle dispersion liquid A having a central diameter of 177 nm.

Preparation of Release Agent Particle Dispersion Liquid B

| | |
|---|---|
| Paraffin wax (trade name: HNP9, manufactured by Nippon Seiro Co., Ltd., melting point 75° C.) | 45 parts by mass |

-continued

| | |
|---|---|
| Cationic surfactant (trade name: Neogen RK, manufactured by Dai-ichi Kogyo Seiyaku Co., Ltd.) | 5 parts by mass |
| Ion exchanged water | 200 parts by mass |

The above components are mixed and heated to 80° C., and the mixture is pre-dispersed by a homogenizer (Ultra-Turrax®, manufactured by IKA Japan K.K.) for 10 min. Dispersion is carried out using Gaulin homogenizer (pressure-ejective type pulverizer, manufactured by Gaulin Inc.) to give a release agent particle dispersion liquid B having a central diameter of 181 nm.

Preparation of Release Agent Particle Dispersion Liquid C

| | |
|---|---|
| Paraffin wax (trade name: HNP3, manufactured by Nippon Seiro Co., Ltd., melting point 65° C.) | 45 parts by mass |
| Cationic surfactant (trade name: Neogen RK, manufactured by Dai-ichi Kogyo Seiyaku Co., Ltd.) | 5 parts by mass |
| Ion exchanged water | 150 parts by mass |

The above components are mixed and heated to 70° C., and the mixture is pre-dispersed by a homogenizer (Ultra-Turrax®, manufactured by IKA Japan K.K.) for 10 min. Dispersion is carried out using Gaulin homogenizer (pressure-ejective type pulverizer, manufactured by Gaulin Inc.) to give a release agent particle dispersion liquid C having a central diameter of 196 nm.

Example 1

Preparation of Toner

The components in Table 1 are mixed to disperse using a homogenizer (Ultra-Turrax®, manufactured by IKA Japan K.K.) in a round-shaped stainless flask. To the solution is added polyaluminum chloride (0.3 parts by mass) to prepare core-aggregated particles, which is further dispersed in the ULTRA-TURRAX for 5 min. The dispersion in the flask is then stirred in an oil bath with heating, and the temperature is raised to 51° C. and kept at 51° C. for 1 hrs to form core aggregated particles. The resin particles A (130 parts by mass) are added thereto to prepare core/shell aggregated particles. 0.5 N Aqueous solution of sodium hydroxide is then added thereto to adjust the pH of the solution to 6, and the temperature is raised to 95° C. The pH is adjusted to 4 using 0.5 N nitric acid, and the temperature is kept at 96° C. for 5 hrs. The mixture is cooled, neutralized with an alkaline and filtered. The residue is washed with water, separated from liquid and dried in vacuo to give a black toner.

Measurement of Physical Properties of Toner

The toner of Example 1 is measured using a Coulter counter (TA-II type, manufactured by Beckman Coulter, Inc.) to give values of the volume average particle size represented by D50, the volume average particle size distribution index represented by GSDv and the number average particle size distribution index represented by GSDp of the toner are obtained. The results are show in Table 2.

Addition of External Additives and Distribution of Developer

To the toner of Example 1 (50 parts by mass) is added hydrophobic silica (trade name: TS720, manufactured by Cabot Corporation, 3.5 parts by mass) as an external additive, and the mixture is blended by a sample mill. To a ferrite carrier in which the surface of ferrite particles having the average particle size of 50 μm has been coated with polymethylmethacrylate (PMMA, 1% by mass of amount of ferrite) is added the toner of Example 1 in which the external additive has been added at the toner concentration of 5% by mass to prepare a developer.

Evaluation of a Developer

The toner is uniformly loaded in an amount of 4.5 g/m$^2$ on paper in a rectangular form (length: 10 mm, width: 35 mm), and the toner is fused at the temperature of 180° C. The paper in which the toner has been fused on an aluminum substrate is mounted on a universal tensile tester, and the temperature is raised to 180° C. in a thermostatic chamber. The adhesive forces of the fused image and aluminum substrate are calculated by the universal tensile tester. The results are shown in Table 2.

Furthermore, image formation test is carried out by applying a modified device of Vivace 555 (trade name, manufactured by Fuji Xerox Co., Ltd.) as an image output evaluation device. Using the above-mentioned developer, the amount of the toner is adjusted to 4.5 g/m$^2$, and an image is formed and fused on paper (trade name: PAL4, manufactured by Fuji Xerox Co., Ltd.) at the process speed of 220 mm/sec. As a fusing roll, a roll having a diameter of 135 mm (manufactured by SUS) is used without coating.

As a result, the obtained image is sufficiently fused, and the surface of the paper on which an image has been formed and the surface of the fusing roll smoothly release during the fusing step. Furthermore, there is no problem of offset resistance, and a good image is provided. The results are shown in Table 3.

Example 2

The developer of Example 2 is prepared by preparing a toner according to a similar manner to Example 1, except that the components, aggregation temperature and coalescence temperature used for the preparation of the toner are changed to the conditions as shown in Table 1, and adding external additives according to a similar manner to Example 1. The results of the measurements of the physical properties of the toner and the adhesive force of the developer are shown in Table 2.

As a result of the image formation test, the obtained image is sufficiently fused, the surface of the paper on which an image has been formed and the surface of the fusing roll smoothly release during the fusing step. Furthermore, there is no problem of offset resistance, and a good image is provided. The results are shown in Table 3.

Example 3

The developer of Example 3 is prepared by preparing a toner according to a similar manner to Example 1, except that the components, aggregation temperature and coalescence temperature used for the preparation of the toner are changed to the conditions as shown in Table 1, and adding external additives according to a similar manner to Example 1. The results of the measurements of the physical properties of the toner and the adhesive force of the developer are shown in Table 2.

As a result of the image formation test, the obtained image is sufficiently fused, the surface of the paper on which an image has been formed and the surface of the fusing roll smoothly release during the fusing step. Furthermore, there is no problem of offset resistance, and a good image is provided. The results are shown in Table 3.

Example 4

The developer of Example 4 is prepared by preparing a toner according to a similar manner to Example 1, except that the components, aggregation temperature and coalescence temperature used for the preparation of the toner are changed to the conditions as shown in Table 1, and adding external additives according to a similar manner to Example 1 except that the fusing roll is replaced with an aluminum roll having a diameter of 135 mm. The results of the measurements of the physical properties of the toner and the adhesive force of the developer are shown in Table 2.

As a result of the image formation test, the obtained image is sufficiently fused, the surface of the paper on which an image has been formed and the surface of the fusing roll smoothly release during the fusing step. Furthermore, there is no problem of offset resistance, and a good image is provided. The results are shown in Table 3.

Example 5

The developer of Example 5 is prepared by preparing a toner according to a similar manner to Example 4, except that the components, aggregation temperature and coalescence temperature used for the preparation of the toner are changed to the conditions as shown in Table 1, using an aluminum roll having a diameter of 135 mm according to a similar manner to Example 4, and adding external additives according to a similar manner to Example 4. The results of the measurements of the physical properties of the toner and the adhesive force of the developer are shown in Table 2.

As a result of the image formation test, the obtained image is sufficiently fused, the surface of the paper on which an image has been formed and the surface of the fusing roll smoothly release during the fusing step. Furthermore, there is no problem of offset resistance, and a good image is provided. The results are shown in Table 3.

Example 6

Before preparing a toner used for Example 6, the following samples are prepared.

Preparation of Polyester Resin A

| | |
|---|---|
| Bisphenol A propyleneoxide adduct | 20 parts by mass |
| Bisphenol A ethyleneoxide adduct | 80 parts by mass |
| Terephthalic acid | 100 parts by mass |
| Fumaric acid | 50 parts by mass |
| Hydroquinone (polymerization inhibitor) | 0.1 parts by mass |

The above substances are charged in a four-necked glass flask (3L) with a catalyst for esterification (dibutyltin oxide). A stainless stirrer bar, a reflux condenser and a nitrogen-induction tube are attached to the flask, and the reaction is carried out in an electrotherm mantle heater under nitrogen stream, at 230° C. and under ordinary pressure in the first half time and at 200° C. and under reduced pressure in the last half time while the mixture is stirred. The obtained polyester resin A has an acid value of 10.2 KOH mg/g, a hydroxyl value of 23.8 KOH mg/g, a glass transition temperature of 65.2° C., and a weight average molecular weight by GPC of 12000.

Preparation of Polyester Resin B (Crosslinked Polyester)

| | |
|---|---|
| Bisphenol A propyleneoxide adduct | 80 parts by mass |
| Bisphenol A ethyleneoxide adduct | 20 parts by mass |
| Trimellitic anhydride | 4.8 parts by mass |
| Dodecenyl succinic anhydride | 25 parts by mass |
| Dibutyltin oxide | 0.1 parts by mass |

Using the above substances, the reaction is carried out according to a similar manner to that of polyester resin A. The obtained polyester resin B has an acid value of 8.7 KOH mg/g, a hydroxyl value of 15.7 KOH mg/g, a glass transition temperature of 63.5° C., and a weight average molecular weight by GPC of 158000.

Preparation of a Coloring Agent Dispersion Liquid E

| | |
|---|---|
| C.I. Pigment Yellow 180 (manufactured by Dainichiseika Color & Chemicals Mfg. Co. Ltd.) | 98 parts by mass |
| Pigment dispersant (trade name: Solsperse 24000, manufactured by ZENECA) | 2 parts by mass |
| Ethyl acetate | 100 parts by mass |

To a dispersion liquid having the above material composition are added glass beads, and the mixture is charged in a sand mill dispersing machine. The mixture is dispersed at high-speed stirring mode for 3 hrs while cooling around the dispersing machine, and diluted with ethyl acetate to prepare a coloring agent dispersion liquid E having a pigment concentration of 10% by mass.

Preparation of Release Agent Dispersion Liquid D

| | |
|---|---|
| Paraffin wax (trade name: HNP9, manufactured by Nippon Seiro Co., Ltd.) | 20 parts by mass |
| Ethyl acetate | 80 parts by mass |

The above materials are charged in a dispersing machine, which has stirring blades and function of circling a heat medium around a vessel. The mixture is stirred at 83 rpm while the temperature is gradually raised, and finally stirred for 3 hrs while the temperature is kept at 100° C. The mixture was cooled to the room temperature by the rate of 2° C./min while the mixture is stirring to give microparticles. The average particle size of the wax is measured to be 1.23 μm using a laser diffraction/scattering particle size distribution measuring apparatus (trade name: LA-700, manufactured by Horiba, Ltd.). The release agent dispersion liquid is dispersed again using a high pressure emulsifier (trade name: APV Gaulin Homogenizer 15MR type, manufactured by APV Gaulin International) at the pressure of 500 kg/cm$^2$. The wax particle size is similarly measured and found to be 0.77 μm. The prepared release agent dispersion liquid D is diluted with ethyl acetate so that the mass concentration of the wax becomes 20% by mass.

Preparation of Oil Phase A

| | |
|---|---|
| Polyester resin A | 50 parts by mass |
| Polyester resin B | 50 parts by mass |
| Coloring agent dispersion liquid E (pigment concentration 10% by mass) | 50 parts by mass |

-continued

| | |
|---|---|
| Release agent dispersion liquid D (wax concentration 20% by mass) | 125 parts by mass |
| Silica (trade name: R972, manufactured by Aerosil) | 15 parts by mass |
| Ethyl acetate | 10 parts by mass |

An oil phase having the above material composition is prepared. The oil phase was charged in a homomixer (trade name: Ace homogenizer, manufactured by Nippon Seiki Co. Ltd.) and stirred at 15000 rpm for 5 min to prepare a homogenous oil phase A.

Preparation of Calcium Carbonate Dispersion Liquid A

| | |
|---|---|
| Calcium carbonate (trade name: Luminus, manufactured by Maruo Calcium Co, Ltd.) | 60 parts by mass |
| Pure water | 40 parts by mass |

The above materials are stirred in a ball mill for 4 days to prepare a calcium carbonate dispersion liquid A.

Preparation of Carboxymethylcellulose Aqueous Solution A

| | |
|---|---|
| Carboxymethylcellulose (CELLOGEN ® BSH, manufactured by Dai-ichi Kogyo Seiyaku, Co., Ltd.) | 2 parts by mass |
| Pure water | 98 parts by mass |

The above materials are dissolved to prepare a carboxymethylcellulose aqueous solution A.

Preparation of a Toner

| | |
|---|---|
| Oil phase A | 60 parts by mass |
| Calcium carbonate dispersion liquid A | 10 parts by mass |
| Carboxymethylcellulose aqueous solution A | 30 parts by mass |

The above components are emulsified in ULTRA-TURRAX® (manufactured by IKA Japan K.K.) at 10000 rpm for 3 min. To the emulsion is then added 25% aqueous solution of ammonium (0.22 parts by mass), and the mixture is stirred overnight while the air is exhausting in a draft chamber, and the solvent is removed. 12 N hydrochloric acid is then added to the mixture until the pH becomes 2, and calcium carbonate is removed from the toner surface. 10 N sodium hydroxide is then added thereto until the pH becomes 10, and the mixture is stirred in a ultrasonic washing bath for 1 hr. Furthermore, centrifugal sedimentation is carried out, and the supernatant is washed by exchanging it three times and dried to collect a toner.

To the above toner are added external additives in a similar manner to Example 4 to prepare the developer of Example 6. The results of measurements of the physical properties of the toner and the adhesive force of the developer are shown in Table 2.

As a result of the image formation test, the obtained image is sufficiently fused, and the surface of the paper on which an image has been formed and the surface of the fusing roll smoothly release during the fusing step. Furthermore, there is no problem of offset resistance, and a good image is provided. The results are shown in Table 3.

Comparative Example 1

As shown in Table 1, the developer of Comparative Example 1 is prepared by preparing a toner according to the similar manner to Example 1, except that the amount of the release agent dispersion liquid A: 100 parts by mass used as a component for preparing the toner of Example 1 is changed to 25 parts by mass, and adding external additives according to the similar manner to Example 1. The results of measurements of the physical properties of the toner and the adhesive force of the developer are shown in Table 2.

As a result of the image formation test, the fusing property of the obtained image is sufficient, but the surface of the paper on which an image has been formed and the surface of the fusing roll do not release smoothly during the fusing step. Furthermore, the offset resistance is bad, and a good image is not obtained. The results are shown in Table 3.

Comparative Example 2

As shown in Table 1, the developer of Comparative Example 2 is prepared by preparing a toner according to the similar manner to Example 4, except that the amount of the resin dispersion liquid A of core particles: 90 parts by mass is changed to 0 parts by mass, the amount of the resin dispersion liquid C is changed to 250 parts by mass, and the amount of the resin dispersion liquid A of the shell: 130 parts by mass is changed to 110 parts by mass, and adding external additives according to the similar manner to Example 4. The results of measurements of the physical properties of the toner and the adhesive force of the developer are shown in Table 2.

As a result of the image formation test, the peeling property of the surface of the paper on which an image has been formed and the surface of the fusing roll is not sufficient during the fusing step. Furthermore, the evaluation of the image cannot be carried out sufficiently due to winding to the fusing roll and offset of the image. The results are shown in Table 3.

Comparative Example 3

The developer of Comparative Example 3 is prepared by preparing a toner according to the similar manner to Example 6 except that silica R972 is excluded from the oil phase in Example 6, and adding external additives according to the similar manner to Example 6. The results of measurements of the physical properties of the toner and the adhesive force of the developer are shown in Table 2.

As a result of the image formation test, the peeling property of the surface of the paper on which an image has been formed and the surface of the fusing roll is not sufficient during the fusing step. Furthermore, the evaluation of the image cannot be carried out sufficiently due to winding to the fusing roll and offset of the image. The results are shown in Table 3.

TABLE 1

| | | Examples | | | | | Comparative Examples | |
|---|---|---|---|---|---|---|---|---|
| | | 1 | 2 | 3 | 4 | 5 | 1 | 2 |
| Core | Resin A | 90 | 150 | 90 | 90 | 90 | 90 | |
| | Resin B | 150 | 70 | 150 | | | 150 | |
| | Resin C | | | | 150 | 95 | | 250 |

TABLE 1-continued

| | Examples | | | | | Comparative Examples | |
|---|---|---|---|---|---|---|---|
| | 1 | 2 | 3 | 4 | 5 | 1 | 2 |
| Shell Resin A | 130 | 130 | 130 | 130 | 130 | 130 | 110 |
| Coloring agent A | 60 | 40 | | | | 60 | |
| Coloring agent B | | | 50 | | | | |
| Coloring agent C | | | | 50 | | | 50 |
| Coloring agent D | | | | | 50 | | |
| Release agent A | 100 | 220 | | | | 25 | |
| Release agent B | | | 155 | | | | |
| Release agent C | | | | | 250 | | |
| Release agent WP100 | | | | 50 | | | 50 |
| Aggregation temperature (° C.) | 51 | 51 | 49 | 48 | 52 | 51 | 48 |
| Coalescence temperature (° C.) | 96 | 96 | 96 | 96 | 96 | 96 | 96 |

The units for resin, coloring agent and release agent are each parts by mass.

The blank columns each represent that the content is 0 parts by mass.

The release agent WP100 is a release agent dispersion liquid WP100 (trade name, manufactured by Mitsui Chemicals Co., Ltd.).

Example 6 and Comparative Example 3 are explained in the description.

As is apparent from Tables 1 to 3, according to the toner for electrophotography of the invention, heat-fusing can be carried out irrespective of the material of the heat-fusing roll, and a good image quality can be obtained.

Secondly, Examples 7 to 12 and Comparative Examples 4 to 7 are explained as examples using toners comprising organic or inorganic microparticles as a component.

Before preparing toners used in Examples 7 to 12 and Comparative Examples 4 to 7, the following samples are prepared.

Preparation of Resin Particle Dispersion Liquid A'

| | |
|---|---|
| Styrene (manufactured by Wako Pure Chemical Industries, Ltd.) | 306 parts by mass |
| n-Butylacrylate (manufactured by Wako Pure Chemical Industries, Ltd.) | 94 parts by mass |
| β-Carboxyethylacrylate (manufactured by Rhodia Nicca, Ltd.) | 12 parts by mass |
| 1,10-Decanedioldiacrylate (manufactured by Shin-Nakamura Chemical Co., Ltd.) | 6.3 parts by mass |
| Dodecanethiol (manufactured by Wako Pure Chemical Industries, Ltd.) | 21.4 parts by mass |

The above components are mixed to dissolve. To the mixture is added a solution of an anionic surfactant (trademark: DOWFAX, manufactured by The Dow Chemical Company, 4 parts by mass) in ion exchanged water (570

TABLE 2

| | | Examples | | | | | | Comparative Examples | | |
|---|---|---|---|---|---|---|---|---|---|---|
| | | 1 | 2 | 3 | 4 | 5 | 6 | 1 | 2 | 3 |
| Volume average particle size D50 (μm) | | 7.0 | 6.7 | 5.6 | 4.5 | 7.3 | 8.5 | 6.6 | 7.0 | 6.5 |
| Average particle size distribution | Volume GSDv | 1.24 | 1.22 | 1.24 | 1.24 | 1.22 | 1.23 | 1.20 | 1.28 | 1.22 |
| | Number GSDp | 1.26 | 1.25 | 1.26 | 1.26 | 1.24 | 1.38 | 1.22 | 1.30 | 1.35 |
| Release agent Content W (% by mass) | | 10 | 20 | 15 | 20 | 30 | 25 | 20 | 25 | 2.5 |
| Storage modulus (G': 180° C.) ($\times 10^3$ Pa) | | 11.5 | 4.5 | 11.2 | 4.8 | 6.7 | 5.2 | 17.2 | 21 | 1.2 |
| (*1) the formula as shown below ($\times 10^3$ Pa) | | 7.9 | 3.5 | 5.0 | 3.5 | 2.0 | 2.6 | 32.8 | 3.5 | 2.6 |
| Adhesive force (180° C.) (N/m) | | 19.0 | 14.0 | 9.5 | 27.1 | 5.2 | 12.5 | 75.2 | 61.1 | 55.3 |

(*1) is a value calculated from (0.875 × 100-W)/W.

TABLE 3

| | Examples | | | | | | Comparative Examples | | |
|---|---|---|---|---|---|---|---|---|---|
| | 1 | 2 | 3 | 4 | 5 | 6 | 1 | 2 | 3 |
| Surface material of fusing roll | SUS | SUS | SUS | Aluminum | Aluminum | Aluminum | SUS | Aluminum | Aluminum |
| Peeling property | Good | Good | Good | Good | Good | Good | Bad | Bad | Bad |
| Offset resistance | Good | Good | Good | Good | Good | Good | Bad | Bad | Slightly bad |
| Fusing property | Good | Good | Good | Good | Good | Good | Good | Not determined | Not determined |
| Image quality | Good | Good | Good | Good | Good | Good | Bad | Bad | Bad |

parts by mass), and the mixture is dispersed in a flask, emulsified and gently stirred for 10 min. To the mixture is added ion exchanged water (50 parts by mass) in which ammonium persulfate (6 parts by mass) has been dissolved. The air in the flask is then sufficiently purged with nitrogen, and the solution in the flask is heated to 70° C. in an oil bath while the solution is stirred. The emulsion polymerization is then continued for 5 hrs to give an anionic resin particle dispersion liquid A'. The central particle size of the resin microparticles in the resin particle dispersion liquid A' is 238 nm, the amount of solid content is 42.7%, and the weight average molecular weight Mw is 35200.

Preparation of Resin Particle Dispersion Liquid B'

| | |
|---|---|
| Styrene (manufactured by Wako Pure Chemical Industries, Ltd.) | 280 parts by mass |
| n-Butylacrylate (manufactured by Wako Pure Chemical Industries, Ltd.) | 120 parts by mass |
| β-Carboxyethyl acrylate (manufactured by Rhodia Nicca, Ltd.) | 12 parts by mass |

The above components are mixed to dissolve. To the mixture is added a solution of an anionic surfactant (trademark: DOWFAX, manufactured by The Dow Chemical Company, 1.5 parts by mass) in ion exchanged water (550 parts by mass), and the mixture is dispersed in a flask, emulsified and gently stirred for 10 min. To the mixture is added ion exchanged water (50 parts by mass) in which ammonium persulfate (1 parts by mass) has been dissolved. The air in the flask is then sufficiently purged with nitrogen, and the solution in the flask is heated to 70° C. in an oil bath while the solution is stirred. The emulsion polymerization is then continued for 5 hrs to give an anionic resin particle dispersion liquid B'. The central particle size of the resin microparticles in the resin particle dispersion liquid B' is 191 nm, the amount of solid content is 42.1%, the weight average molecular weight Mw is 765000, the number average molecular weight Mn is 267600, and the glass transition temperature is 53.7° C.

Preparation of Resin Particle Dispersion Liquid C'

| | |
|---|---|
| Styrene (manufactured by Wako Pure Chemical Industries, Ltd.) | 280 parts by mass |
| n-Butylacrylate (manufactured by Wako Pure Chemical Industries, Ltd.) | 120 parts by mass |
| β-Carboxyethyl acrylate (manufactured by Rhodia Nicca, Ltd.) | 12 parts by mass |

The above components are mixed to dissolve. To the mixture is added a solution of an anionic surfactant (trademark: DOWFAX, manufactured by The Dow Chemical Company, 1.5 parts by mass) in ion exchanged water (550 parts by mass), and the mixture is dispersed in a flask, emulsified and gently stirred for 10 min. To the mixture is added ion exchanged water (50 parts by mass) in which ammonium persulfate (1.5 parts by mass) has been dissolved. The air in the flask is then sufficiently purged with nitrogen, and the solution in the flask is heated to 70° C. in an oil bath while the solution is stirred. The emulsion polymerization is then continued for 5 hrs to give an anionic resin particle dispersion liquid C'. The central particle size of the resin microparticles in the resin particle dispersion liquid C' is 165 nm, the amount of solid content is 42.5%, the weight average molecular weight Mw is 654100, the number average molecular weight Mn is 197600, and the glass transition temperature is 52.7° C.

Preparation of Microparticle Dispersion Liquid A'

| | |
|---|---|
| Silica R805 (trade name, manufactured by Aerosil) | 75 parts by mass |
| Cationic surfactant (trade name: Neogen RK, manufactured by Dai-ichi Kogyo Seiyaku Co., Ltd.) | 8 parts by mass |
| Ion exchanged water | 1417 parts by mass |

The above components are mixed, and the mixture is pre-dispersed by a homogenizer (Ultra-Turrax®, manufactured by IKA Japan K.K.) for 10 min. Dispersion is carried out using ultrasonic dispersing machine for 30 min to give a microparticle dispersion liquid A' having the central diameter of microparticles of 230 nm.

Preparation of a Microparticle Dispersion Liquid B'

| | |
|---|---|
| Titania P25 | 150 parts by mass |
| Cationic surfactant (trade name: Neogen RK, manufactured by Dai-ichi Kogyo Seiyaku Co., Ltd.) | 20 parts by mass |
| Ion exchanged water | 830 parts by mass |

The above components are mixed, and the mixture is pre-dispersed by a homogenizer (Ultra-Turrax®, manufactured by IKA Japan K.K.) for 10 min. Dispersion is carried out using ultrasonic dispersing machine for 30 min to give a microparticle dispersion liquid B' having the central diameter of microparticles of 260 nm.

Preparation of a Microparticle Dispersion Liquid C'

| | |
|---|---|
| Silica A200 | 100 parts by mass |
| Cationic surfactant (trade name: Neogen RK, manufactured by Dai-ichi Kogyo Seiyaku Co., Ltd.) | 10 parts by mass |
| Ion exchanged water | 890 parts by mass |

The above components are mixed, and the mixture is pre-dispersed by a homogenizer (Ultra-Turrax®, manufactured by IKA Japan K.K.) for 10 min. Dispersion is carried out using ultrasonic dispersing machine for 30 min to give a microparticle dispersion liquid C' having the central diameter of microparticles of 320 nm.

The coloring agent particle dispersion liquids A to D and release agent particle dispersion liquids A to C used are the same as those used in Examples 1 to 6 and Comparatives Example 1 to 3.

Example 7

The developer of Example 7 is prepared by preparing a toner according to a similar manner to Example 1, except that the components, aggregation temperature and coalescence temperature used for the preparation of the toner are changed to the conditions as shown in Table 4, and adding external additives according to a similar manner to Example 1. The results of the measurements of the physical properties of the toner and the adhesive force of the developer are shown in Table 5.

As a result of the image formation test, the obtained image is sufficiently fused, the surface of the paper on which an image has been formed and the surface of the fusing roll smoothly release during the fusing step. Furthermore, there is no problem of offset resistance, and a good image is provided. The results are shown in Table 6.

Example 8

The developer of Example 8 is prepared by preparing a toner according to a similar manner to Example 7, except that the components, aggregation temperature and coalescence temperature used for the preparation of the toner are changed to the conditions as shown in Table 4, and adding external additives according to a similar manner to Example 7, except that the fusing roll is replaced with an aluminum roll having a diameter of 135 mm. The results of the measurements of the physical properties of the toner and the adhesive force of the developer are shown in Table 5.

As a result of the image formation test, the obtained image has been sufficiently fused, the surface of the paper on which an image has been formed and the surface of the fusing roll smoothly release during the fusing step. Furthermore, there is no problem of offset resistance, and a good image is provided. The results are shown in Table 6.

Example 9

The developer of Example 9 is prepared by preparing a toner according to a similar manner to Example 7, except that the components, aggregation temperature and coalescence temperature used for the preparation of the toner are changed to the conditions as shown in Table 4, and adding external additives according to a similar manner to Example 7. The results of the measurements of the physical properties of the toner and the adhesive force of the developer are shown in Table 5.

As a result of the image formation test, the obtained image is sufficiently fused, the surface of the paper on which an image has been formed and the surface of the fusing roll smoothly release during the fusing step. Furthermore, there is no problem of offset resistance, and a good image is provided. The results are shown in Table 6.

Example 10

The developer of Example 10 is prepared by preparing a toner according to a similar manner to Example 7, except that the components, aggregation temperature and coalescence temperature used for the preparation of the toner are changed to the conditions as shown in Table 4, and adding external additives according to a similar manner to Example 7. The results of the measurements of the physical properties of the toner and the adhesive force of the developer are shown in Table 5.

As a result of the image formation test, the obtained image has been sufficiently fused, the surface of the paper on which an image has been formed and the surface of the fusing roll smoothly release during the fusing step. Furthermore, there is no problem of offset resistance, and a good image is provided. The results are shown in Table 6.

Example 11

The developer of Example 11 is prepared by preparing a toner according to a similar manner to Example 8, except that the components, aggregation temperature and coalescence temperature used for the preparation of the toner are changed to the conditions as shown in Table 4, using an aluminum roll having a diameter of 135 mm according to a similar manner to Example 8, and adding external additives according to a similar manner to Example 8. The results of the measurements of the physical properties of the toner and the adhesive force of the developer are shown in Table 5.

As a result of the image formation test, the obtained image is sufficiently fused, the surface of the paper on which an image has been formed and the surface of the fusing roll smoothly release during the fusing step. Furthermore, there is no problem of offset resistance, and a good image is provided. The results are shown in Table 6.

Example 12

Before preparing a toner used in Example 12, the following samples are prepared.

Preparation of Polyester Resin A'

| | |
|---|---|
| Bisphenol A propyleneoxide adduct | 20 parts by mass |
| Bisphenol A ethyleneoxide adduct | 80 parts by mass |
| Terephthalic acid | 100 parts by mass |
| Fumaric acid | 50 parts by mass |
| Hydroquinone (polymerization inhibitor) | 0.1 parts by mass |

The above substances are charged in a four-necked glass flask (3L) with a catalyst for esterification (dibutyltin oxide). A stainless stirrer bar, a reflux condenser and a nitrogen-induction tube are attached to the flask, and the reaction is carried out in an electrotherm mantle heater under nitrogen stream, at 230° C. and under ordinary pressure in the first half time and at 200° C. and under reduced pressure in the last half time while the mixture is stirred. The obtained polyester resin A has an acid value of 10.5 KOH mg/g, a hydroxyl value of 23.9 KOH mg/g, a glass transition temperature of 65.0° C., and a weight average molecular weight by GPC of 11500.

Preparation of Polyester Resin B' (Crosslinked Polyester)

| | |
|---|---|
| Bisphenol A propyleneoxide adduct | 80 parts by mass |
| Bisphenol A ethyleneoxide adduct | 20 parts by mass |
| Trimellitic anhydride | 4.8 parts by mass |
| Dodecenyl succinic anhydride | 25 parts by mass |
| Dibutyltin oxide | 0.1 parts by mass |

Using the above substances, the reaction is carried out according to a similar manner to that of polyester resin A'. The obtained polyester resin B' has an acid value of 8.8 KOH mg/g, a hydroxyl value of 15.9 KOH mg/g, a glass transition temperature of 63.5° C., and a weight average molecular weight by GPC of 163000.

Preparation of a Coloring Agent Dispersion Liquid E'

| | |
|---|---|
| C.I. Pigment Yellow 180 (manufactured by Dainichiseika Color & Chemicals Mfg. Co. Ltd.) | 98 parts by mass |
| Pigment dispersant (trade name: Solsperse 24000, manufactured by ZENECA) | 2 parts by mass |
| Ethyl acetate | 100 parts by mass |

To a dispersion liquid having the above material composition are added glass beads, and the mixture is charged in a sand mill dispersing machine. The mixture is dispersed at high-speed stirring mode for 3 hrs while cooling around the dispersing machine, and diluted with ethyl acetate to prepare a coloring agent dispersion liquid E' having a pigment concentration of 10% by mass.

Preparation of Release Agent Dispersion Liquid D'

| | |
|---|---|
| Paraffin wax (trade name: FNP0090, manufactured by Nippon Seiro Co., Ltd.) | 20 parts by mass |
| Ethyl acetate | 80 parts by mass |

The above materials are charged in a dispersing machine, which has stirring blades and circulates a heat medium around a vessel. The mixture is stirred at 83 rpm while the temperature is gradually raised, and finally stirred for 3 hrs while the temperature is kept at 100° C. The mixture was cooled to the room temperature by the rate of 2° C./min while the mixture is stirring to give microparticles. The average particle size of the wax is measured to be 1.34 μm using a laser diffraction/scattering particle size distribution measuring apparatus (trade name: LA-700, manufactured by Horiba, Ltd.). The release agent dispersion liquid is dispersed again using a high pressure emulsifier (trade name: APV Gaulin Homogenizer 15MR type, manufactured by APV Gaulin International) at the pressure of 500 kg/cm$^2$. The wax particle size is similarly measured and found to be 0.81 μm. The prepared release agent dispersion liquid D is diluted with ethyl acetate so that the mass concentration of the wax becomes 20% by mass.

Preparation of Oil Phase A'

| | |
|---|---|
| Polyester resin A' | 55 parts by mass |
| Polyester resin B' | 45 parts by mass |
| Coloring agent dispersion liquid E' (pigment concentration 10% by mass) | 50 parts by mass |
| Release agent dispersion liquid D' (wax concentration 20% by mass) | 150 parts by mass |
| Silica (trade name: R972, manufactured by Aerosil) | 10 parts by mass |
| Ethyl acetate | 10 parts by mass |

An oil phase having the above material composition is prepared. The oil phase was charged in a homomixer (trade name: Ace homogenizer, manufactured by Nippon Seiki Co. Ltd.) and stirred at 15000 rpm for 5 min to prepare a homogenous oil phase A'.

Preparation of Calcium Carbonate Dispersion Liquid A'

| | |
|---|---|
| Calcium carbonate (trade name: Luminus, manufactured by Maruo Calcium Co, Ltd.) | 60 parts by mass |
| Pure water | 40 parts by mass |

The above materials are stirred in a ball mill for 4 days to prepare a calcium carbonate dispersion liquid A'.

Preparation of Carboxymethylcellulose Aqueous Solution A'

| | |
|---|---|
| Carboxymethylcellulose (CELLOGEN ® BSH, manufactured by Dai-ichi Kogyo Seiyaku, Co., Ltd.) | 2 parts by mass |
| Pure water | 98 parts by mass |

The above materials are dissolved to prepare a carboxymethylcellulose aqueous solution A'.

Preparation of a Toner

| | |
|---|---|
| Oil phase A' | 60 parts by mass |
| Calcium carbonate dispersion liquid A' | 8 parts by mass |
| Carboxymethylcellulose aqueous solution A' | 30 parts by mass |

The above components are emulsified in ULTRA-TURRAX (mentioned above) at 10000 rpm for 3 min. To the emulsion is then added 25% aqueous solution of ammonium (0.22 parts by mass), and the mixture is stirred overnight while the air is exhausting in a draft chamber, and the solvent is removed. 12 N Hydrochloric acid is then added to the mixture until the pH becomes 2, and calcium carbonate is removed from the toner surface. 10 N Sodium hydroxide is then added thereto until the pH becomes 10, and the mixture is stirred in a ultrasonic washing bath for 1 hr. Furthermore, centrifugal sedimentation is carried out, and washed the supernatant by exchanging it three times and dried to collect a toner.

To the above toner are added external additives in a similar manner to Example 8 to prepare a developer of Example 12. The results of measurements of the physical properties of the toner and the adhesive force of the developer are shown in Table 5.

As a result of the image formation test, the obtained image has been sufficiently fused, the surface of the paper on which an image has been formed and the surface of the fusing roll smoothly release during the fusing step. Furthermore, there is no problem of offset resistance, and a good image is provided. The results are shown in Table 6.

Comparative Example 4

As shown in Table 4, the developer of Comparative Example 4 is prepared by preparing a toner according to the similar manner to Example 7, except that the amount of the release agent dispersion liquid A: 110 parts by mass used as a component for preparing the toner of Example 7 is changed to 20 parts by mass, and adding external additives according to the similar manner to Example 7. The results of measurements of the physical properties of the toner and the adhesive force of the developer are shown in Table 5.

As a result of the image formation test, the fusing property of the obtained image is sufficient, but the surface of the paper on which an image has been formed and the surface of the fusing roll do not release smoothly during the fusing step. Furthermore, the offset resistance is bad, and a good image is not obtained. The results are shown in Table 6.

Comparative Example 5

As shown in Table 4, the developer of Comparative Example 5 is prepared by preparing a toner according to the similar manner to Example 8, except that the amount of the microparticle dispersion liquid A': 160 parts by mass is changed to 0 parts by mass, and adding external additives according to the similar manner to Example 8. The results of measurements of the physical properties of the toner and the adhesive force of the developer are shown in Table 5.

As a result of the image formation test, the peeling property of the surface of the paper on which an image has been formed and the surface of the fusing roll is not sufficient during the fusing step. Furthermore, the evaluation of the image cannot be carried out due to winding to the fusing roll and offset of the image. The results are shown in Table 5.

Comparative Example 6

As shown in Table 4, the developer of Comparative Example 6 is prepared by preparing a toner according to the similar manner to Example 9, except that the amount of the microparticle dispersion liquid B': 20 parts by mass is changed to 400 parts by mass and, the amount of the release agent C is changed to 240 parts by mass, and adding external additives according to the similar manner to Example 9. The results of measurements of the physical properties of the toner and the adhesive force of the developer are shown in Table 5.

As a result of the image formation test, the peeling property of the surface of the paper on which an image has been formed and the surface of the fusing roll is slightly bad during the fusing step. Furthermore, the evaluation of the image cannot be carried out sufficiently due to winding to the fusing roll and offset of the image. The results are shown in Table 5.

Comparative Example 7

The developer of Comparative Example 7 is prepared by preparing a toner according to the similar manner to Example 12 except that silica R972 (mentioned above) is excluded from the oil phase in Example 12, and adding external additives according to the similar manner to Example 12. The results of measurements of the physical properties of the toner and the adhesive force of the developer are shown in Table 5.

As a result of the image formation test, the fusing property of the obtained image is sufficient, but the surface of the paper on which an image has been formed and the surface of the fusing roll do not release smoothly during the fusing step. Furthermore, the offset resistance is bad, and a good image is not obtained. The results are shown in Table 6.

TABLE 4

| | | Examples | | | | | Comparative Examples | | |
|---|---|---|---|---|---|---|---|---|---|
| | | 7 | 8 | 9 | 10 | 11 | 4 | 5 | 6 |
| Core | Resin A' | 140 | 130 | 120 | 155 | 100 | 140 | 130 | 120 |
| | Resin B' | 40 | 60 | 150 | | | 40 | 60 | 150 |
| | Resin C' | | | | 20 | 80 | | | |
| Shell | Resin A' | 130 | 110 | 100 | 130 | 80 | 130 | 110 | 100 |
| Microparticle A' | | 160 | 160 | | | | 160 | | |
| Microparticle B' | | | | 20 | | | | | 400 |
| Microparticle C' | | | | | 85 | 310 | | | |
| Coloring agent A | | 50 | | | | | 50 | | |
| Coloring agent B | | | 50 | | | | | 50 | |
| Coloring agent C | | | | 100 | | | | | 100 |
| Coloring agent D | | | | | 75 | 100 | | | |
| Release agent A | | 110 | 90 | | | | 20 | 90 | |
| Release agent B | | | | 100 | 330 | | | | 100 |
| Release agent C | | | | | | 240 | | | 240 |
| Aggregation temperature (° C.) | | 53 | 54 | 56 | 51 | 57 | 53 | 54 | 56 |
| Coalescence temperature (° C.) | | 95 | 96 | 96 | 95 | 95 | 95 | 96 | 96 |

The units for resin, microparticle, coloring agent and release agent are each parts by mass.

The blank columns each represent that the content is 0 parts by mass.

Example 12 and Comparative Example 7 are explained in the description.

TABLE 5

| | | Examples | | | | | | Comparative Examples | | | |
|---|---|---|---|---|---|---|---|---|---|---|---|
| | | 7 | 8 | 9 | 10 | 11 | 12 | 4 | 5 | 6 | 7 |
| Volume average particle size D50 (μm) | | 5.3 | 5.8 | 6.3 | 5.1 | 7.2 | 9.3 | 5.1 | 6.0 | 6.1 | 8.5 |
| Average particle size distribution | Volume GSDv | 1.25 | 1.25 | 1.23 | 1.29 | 1.30 | 1.245 | 1.24 | 1.23 | 1.32 | 1.22 |
| | Number GSDp | 1.28 | 1.28 | 1.27 | 1.34 | 1.33 | 1.39 | 1.27 | 1.25 | 1.37 | 1.33 |
| Release agent Content W (% by mass) | | 12.9 | 10.9 | 10.0 | 38.2 | 28.2 | 21.4 | 2.7 | 11.6 | 25.6 | 23.08 |

TABLE 5-continued

| | Examples | | | | | | Comparative Examples | | | |
|---|---|---|---|---|---|---|---|---|---|---|
| | 7 | 8 | 9 | 10 | 11 | 12 | 4 | 5 | 6 | 7 |
| Storage modulus (G': 180° C.) ($\times 10^3$ Pa) | 7.2 | 8.8 | 13.2 | 2.1 | 9.8 | 0.9 | 5.7 | 4.8 | 190 | 0.4 |
| (*1) the formula as shown below ($\times 10^3$ Pa) | 5.9 | 7.1 | 7.9 | 1.4 | 2.2 | 3.2 | 31.5 | 6.7 | 2.5 | 2.9 |
| Adhesive force (180° C.) (N/m) | 25.6 | 38.2 | 34.5 | 6.7 | 8.7 | 34.6 | 67.0 | 54.5 | 71.5 | 51.2 |

(*1) is a value calculated from (0.875 × 100-W)/W.

TABLE 6

| | Examples | | | | | | Comparative Examples | | | |
|---|---|---|---|---|---|---|---|---|---|---|
| | 7 | 8 | 9 | 10 | 11 | 12 | 4 | 5 | 6 | 7 |
| Surface material of fusing roll | SUS | Aluminum | SUS | SUS | Aluminum | Aluminum | SUS | Aluminum | SUS | Aluminum |
| Release property | Good | Good | Good | Good | Good | Good | Slightly bad | Bad | Slightly bad | Slightly bad |
| Offset resistance | Good | Good | Good | Good | Good | Good | Bad | Bad | Bad | Slightly bad |
| Fusing property | Good | Good | Good | Good | Good | Good | Good | Not determined | Not determined | Good |
| Image quality | Good | Good | Good | Good | Good | Good | Slightly bad | Bad | Bad | Slightly bad |

As is apparent from Tables 4 to 6, according to the toner for electrophotography of the invention, heat-fusing can be carried out irrespective of the material of the heat-fusing roll, and a good image quality can be obtained.

Furthermore, the storage elasticity of the toner can be easily controlled by incorporating organic or inorganic microparticles as a component of the toner.

As explained above, the invention can provide a toner for electrophotography that enables heat-fusing irrespective of the material of the heat-fusing roll and can provide good image quality, and an image-forming method, an image-forming apparatus and a toner cartridge using the toner for electrophotography.

What is claimed is:

1. A toner for electrophotography comprising toner particles that comprise a binder resin, a coloring agent, a release agent, and inorganic or organic particles, wherein the inorganic or organic particles have a particle diameter of 5 to 200 nm and are present in an amount of 1 to 30% by mass, wherein the toner has a storage modulus G' of $5.0\times10^2$ to $1.0\times10^5$ Pa at 180° C. and an adhesive force to an aluminum substrate of not more than 50 N/m at 180° C., and wherein a content W of the release agent is 5 to 40% by mass, and a relationship between the release agent content W and the storage modulus G' satisfies $G' \geqq 0.875\times(100-W)/W(\times10^5\ \text{Pa})$.

2. A toner according to claim 1, wherein the inorganic particles are present in an amount of 1 to 20% by mass.

3. A toner according to claim 1, having a volume average particle size of 4.0 to 10.0 μm.

4. A toner according to claim 1, wherein the melting point of the release agent is 50 to 150° C.

5. An image-forming method, comprising:

charging a surface of an image-bearing body;

forming an electrostatic latent image according to image formation on the charged surface of the image-bearing body;

developing with a toner the electrostatic latent image formed on the surface of the image-bearing body, in order to obtain a toner image;

transferring to a surface of a recording medium the toner image formed on the surface of the image-bearing body, and fusing the toner image transferred on the surface of the recording medium, wherein the toner is a toner for electrophotography comprising toner particles that comprise a binder resin, a coloring agent, a release agent and inorganic or organic particles, wherein the inorganic or organic particles have a particle diameter of 5 to 200 nm and are present in an amount of 1 to 30% by mass, and wherein the toner has a storage modulus G' of $5.0\times10^2$ to $1.0\times10^5$ Pa at 180° C. and an adhesive force to an aluminum substrate of not more than 50 N/m at 180° C. and wherein a content W of the release agent is 5 to 40% by mass, and a relationship between the release agent content W and the storage modulus G' satisfies $G' \geqq 0.875\times(100-W)/W(\times10^5\ \text{Pa})$.

6. A method according to claim 5, wherein the toner comprises inorganic particles having a particle diameter of 5 to 200 nm in an amount of 1 to 20% by mass.

7. A method according to claim 5, wherein the toner has a volume average particle size of 4.0 to 10.0 μm.

8. A method according to claim 5, wherein the melting point of the release agent in the toner is 50 to 150° C.

9. A method according to claim 5, wherein a heat-fusing roll is used for fusing, and the surface energy of a material on the surface of the heat-fusing roll is in the range of $0.1\times10^{-4}$ to $5.0\times10^{-4}$ J/cm$^2$.

10. A toner cartridge detachable from an image-forming apparatus that comprises means for developing, the cartridge containing a toner which is provided to the means for developing, wherein the toner is a toner for electrophotography comprising toner particles that comprise a binder resin, a coloring agent, a release agent and inorganic or organic particles, wherein the inorganic or organic particles have a particle diameter of 5 to 200 nm and are present in an amount of 1 to 30% by mass, and wherein the toner has a storage modulus G' of$5.0\times10^2$ to $1.0\times10^5$ Pa at 180° C. and an adhesive force to an aluminum substrate of not more than 50 N/m at 180° C. and wherein a content W of the release agent is 5 to 40% by mass, and a relationship between the release agent content W and the storage modulus G' satisfies $G' \geqq 0.875\times(100-W)/W(\times10^5\ \text{Pa})$.

* * * * *